US007553382B2

(12) United States Patent
Branagan et al.

(10) Patent No.: US 7,553,382 B2
(45) Date of Patent: Jun. 30, 2009

(54) GLASS STABILITY, GLASS FORMING ABILITY, AND MICROSTRUCTURAL REFINEMENT

(75) Inventors: Daniel J. Branagan, Idaho Falls, ID (US); M. Craig Marshall, Iona, ID (US); Brian Meacham, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 250 days.

(21) Appl. No.: 11/057,400

(22) Filed: Feb. 11, 2005

(65) Prior Publication Data

US 2006/0180252 A1 Aug. 17, 2006

(51) Int. Cl.
*C22C 45/02* (2006.01)

(52) U.S. Cl. ..... 148/561; 148/403; 420/590

(58) Field of Classification Search ..... 420/1–129, 420/580; 148/403, 561
See application file for complete search history.

(56) References Cited

U.S. PATENT DOCUMENTS 4,297,135 A * 10/1981 Giessen et al. ..... 149/321
4,365,994 A * 12/1982 Ray ..... 148/325
4,495,691 A 1/1985 Masumoto et al.
4,842,657 A * 6/1989 Masumoto et al. ..... 148/403
6,258,185 B1 7/2001 Branagan et al.
6,350,323 B1 * 2/2002 Inoue et al. ..... 148/304
6,689,234 B2 2/2004 Branagan et al.
2004/0250929 A1 * 12/2004 Branagan ..... 148/561
2008/0053274 A1 3/2008 Branagan et al.

OTHER PUBLICATIONS

L. Ma et al. Effect of Nb addition on glass-forming ability, strength, and hardness of Fe-B-Zr amorphous alloys, Materials Research Bulletin, vol. 34, No. 6, p. 915-920, (1999).*
P. Marin et al, Influence of Cu and Nb on relaxation and crystallization of amorphous FeSiB(CuNb) wires, Nanostructured materials, vol. 10, No. 2, p. 299-310 (1998).*
T. Kulik, Nanocrystallization of metallic glasses, Journal of Non-Crystalline Solids, vol. 287, p. 145-161 (2001).*
A. Inoue and B. Shen. New Fe-based bulk glassy alloys with high saturated magnetic flux density of 1.4-1.5 T, Materials Science and Engineering A (2004—online Nov. 29, 2003), 375-377, p. 302-306.*
D.J. Branagan and Y. Tang. Developing extreme hardness (>15 GPa) in iron-based nanocomposites, Composites: Part A: vol. 33, (2002), p. 855-859.*

(Continued)

*Primary Examiner*—George Wyszomierski
*Assistant Examiner*—Mark L Shevin
(74) *Attorney, Agent, or Firm*—Grossman, Tucker, Perreault & Pfleger, PLLC

(57) ABSTRACT

The present invention relates to the addition of niobium to iron based glass forming alloys and iron based Cr—Mo—W containing glasses. More particularly, the present invention is related to changing the nature of crystallization resulting in glass formation that may remain stable at much higher temperatures, increasing the glass forming ability and increasing devitrified hardness of the nanocomposite structure.

3 Claims, 4 Drawing Sheets

OTHER PUBLICATIONS

U.S. Office Action dated Jan. 27, 2009 issued in related U.S. Appl. No. 11/843,138.
International Preliminary Report on Patentability dated Jan. 29, 2009 issued in related International Patent Application No. PCT/US2007/073757.
International Search Report and Written Opinion dated Jan. 28, 2008 issued in International Patent Application No. PCT/US0773757.
International Search Report and Written Opinion dated Feb. 14, 2008 issued in International Patent Application No. PCT/US0604198.
Pekala et al., "Transport and Magnetic Properties of HITPERM alloys," IOP Publishing, Nanotechnology 14 (2003) pp. 196-199.
U.S. Office Action dated May 21, 2008 issued in related U.S. Appl. No. 11/843,138.
Branagan, et al., "Developing Extreme Hardness (>15 GPa) in iron based nanocomposites," Composites: Part A 33 (2002) pp. 855-859.
Kishitake, "Characterization of Plasma Sprayed Fe-10Cr-10Mo-(C,B) Amorphous Coatings," Journal of Thermal Spray Technology, vol. 5(2), Jun. 1996, pp. 145-153.

* cited by examiner

GLASS STABILITY, GLASS FORMING ABILITY, AND MICROSTRUCTURAL REFINEMENT

FIELD OF INVENTION

The present invention relates to metallic glasses and more particularly to iron based alloys and iron based Cr—Mo—W containing glasses and more particularly to the addition of Niobium to these alloys.

BACKGROUND

Conventional steel technology is based on manipulating a solid-state transformation called a eutectoid transformation. In this process, steel alloys are heated into a single phase region (austenite) and then cooled or quenched at various cooling rates to form multiphase structures (i.e. ferrite and cementite). Depending on how the steel is cooled, a wide variety of microstructures (ie. pearlite, bainite and martensite) can be obtained with a wide range of properties.

Another approach to steel technology is called glass devitrification, producing steels with bulk nanoscale microstructures. The supersaturated solid solution precursor material is a super cooled liquid, called a metallic glass. Upon superheating, the metallic glass precursor transforms into multiple solid phases through devitrification. The devitrified steels form specific characteristic nanoscale microstructures, analogous to those formed in conventional steel technology.

It has been known for at least 30 years, since the discovery of metallic glasses that iron based alloys could be made to be metallic glasses. However, with few exceptions, these iron based glassy alloys have had very poor glass forming ability and the amorphous state could only be produced at very high cooling rates (>$10^6$ K/s). Thus, these alloys can only be processed by techniques which give very rapid cooling such as drop impact or melt-spinning techniques.

While conventional steels have critical cooling rates for forming metallic glasses in the range of $10^9$ K/s, special iron based metallic glass forming alloys have been developed having a critical cooling rate orders of magnitude lower than conventional steels. Some special alloys have been developed that may produce metallic glasses at cooling rates in the range of $10^4$ to $10^5$ K/s. Furthermore, some bulk glass forming alloys have critical cooling rates in the range of $10^0$ to $10^2$ K/s, however these alloys generally may employ rare or toxic alloying elements to increase glass forming ability, such as the addition of beryllium, which is highly toxic, or gallium, which is expensive. The development of glass forming alloys which are low cost and environmentally friendly has proven much more difficult.

In addition to the difficultly in developing cost effective and environmentally friendly alloys, the very high cooling rate required to produce metallic glass has limited the manufacturing techniques that are available for producing articles from metallic glass. The limited manufacturing techniques available have in turn limited the products that may be formed from metal glasses, and the applications in which metal glasses may be used. Conventional techniques for processing steels from a molten state generally provide cooling rates on the order of $10^{-2}$ to $10^0$ K/s. Special alloys that are more susceptible to forming metallic glasses, i.e., having reduced critical cooling rates on the order of $10^4$ to $10^5$ K/s, cannot be processed using conventional techniques with such slow cooling rates and still produce metallic glasses. Even bulk glass forming alloys having critical cooling rates in the range of $10^0$ to $10^2$ K/s, are limited in the available processing techniques, and have the additional processing disadvantage in that they cannot be processed in air but only under very high vacuum.

SUMMARY

In a summary exemplary embodiment, the present invention relates to an iron based glass alloy composition comprising about 40-65 atomic % iron; about 5-55 atomic % of at least one metal selected from the group consisting of Ti, Zr, Hf, V, Ta, Cr, Mo, W, Mn, Ni or mixtures thereof, and about 0.01-20 atomic % of Niobium.

In another summary exemplary embodiment, the present invention relates to a method for increasing the hardness of an iron alloy composition comprising supplying an iron based glass alloy having a hardness, adding Niobium to the iron based glass alloy, and increasing the hardness by adding the Niobium to the iron based glass alloy.

In another summary exemplary embodiment, the present invention relates to a method for increasing the glass stabilization of an iron based alloy composition comprising supplying an iron based glass alloy having a crystallization temperature of less than 675° C., adding Niobium to the iron based glass alloy, and increasing the crystallization temperature above 675° C. by adding Niobium to the iron based glass alloy.

DETAILED DESCRIPTION

Figure 1:
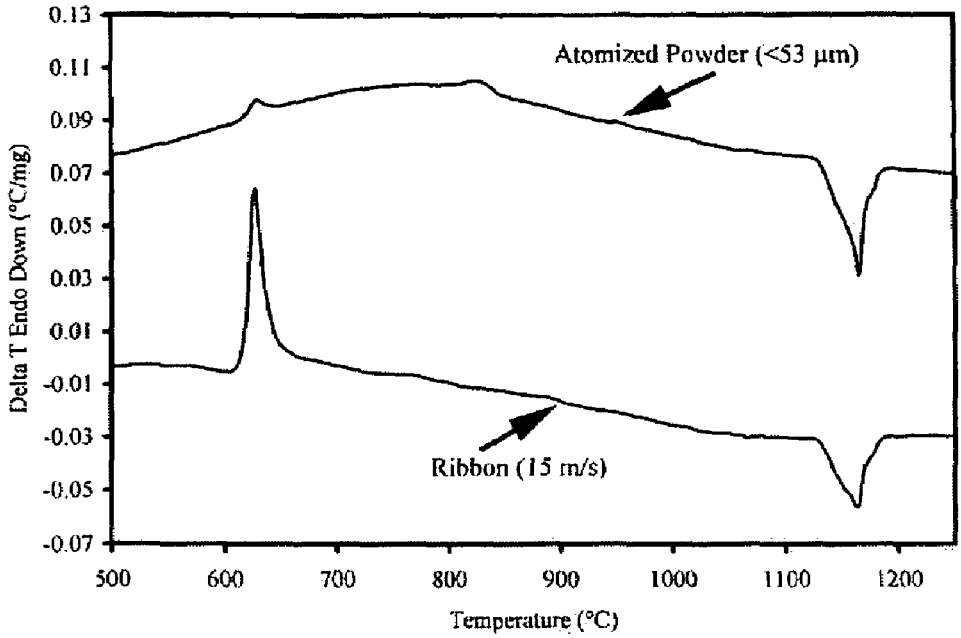
FIG. 1 illustrates DTA plots of Alloy 1 melt spun and gas atomized.

The present invention relates to the addition of niobium to iron based glass forming alloys and iron based Cr—Mo—W containing glasses. More particularly, the present invention is related to changing the nature of crystallization resulting in glass formation that may remain stable at much higher temperatures, increase glass forming ability and increase devitrified hardness of the nanocomposite structure. Additionally, without being bound to any particular theory, it is believed that the supersaturation effect from the niobium addition, may result in the ejection of the niobium from the solidifying solid which may additionally slow down crystallization, possibly resulting in reduced as-crystallized grain/phase sizes.

The present invention ultimately is an alloy design approach that may be utilized to modify and improve existing iron based glass alloys and their resulting properties and may preferably be related to three distinct properties. First, the present invention may be related to changing the nature of crystallization, allowing multiple crystallization events and glass formation which may remain stable at much higher temperatures. Second, the present invention may allow an increase in the glass forming ability. Third, consistent with the present invention, the niobium addition may allow an increase in devitrified hardness of the nanocomposite structure. These effects may not only occur in the alloy design stage but may also occur in industrial gas atomization processing of feedstock and in PTAW welding of hardfacing weld overlays.

Furthermore, the improvements may generally be applicable to a range of industrial processing methods including PTAW, welding, spray forming, MIG (GMAW) welding, laser welding, sand and investment casting and metallic sheet forming by various continuous casting techniques.

A consideration in developing nanocrystalline or even amorphous welds, is the development of alloys with low critical cooling rates for metallic glass formation in a range where the average cooling rate occurs during solidification. This may allow high undercooling to occur during solidification, which may result either in the prevention of nucleation resulting in glass formation or in nucleation being prevented so that it occurs at low temperatures where the driving force of crystallization is very high and the diffusivities are minimal. Undercooling during solidification may also result in very high nucleation frequencies with limited time for growth resulting in the achievement of nanocrystalline scaled microstructures in one step during solidification.

In developing advanced nanostructure welds, the nanocrystalline grain size is preferably maintained in the as-welded condition by preventing or minimizing grain growth. Also preferably, is the reduction of the as-crystallization grain size by slowing down the crystallization growth front which can be achieved by alloying with elements which have high solubility in the liquid/glass but limited solubility in the solid. Thus, during crystallization, the supersaturated state of the alloying elements may result in an ejection of solute in front of the growing crystallization front which may result in a dramatic refinement of the as-crystallized/as solidified phase size. This can be done in multiple stages to slow down growth throughout the solidification regime.

Consistent with the present invention, the nanocrystalline materials may be iron based glass forming alloys, and iron based Cr—Mo—W containing glasses. It will be appreciated that the present invention may suitably employ other alloys based on iron, or other metals, that are susceptible to forming metallic glass materials. Accordingly, an exemplary alloy may include a steel composition, comprising at least 40 at % iron and at least one element selected from the group consisting of Ti, Zr, Hf, V, Nb, Ta, Cr, Mo, W, Al, Mn, or Ni; and at least one element selected from the group consisting of B, C, N, O, P, Si and S.

Niobium may be added to these iron based alloys between 0.01-25 at % relative to the alloys and all incremental values in between, i.e. 0.01-15 at %, 1-10 at %, 5-8 at %, etc. More preferably, the niobium present in the alloy is 0.01-6 at % relative to the alloys.

WORKING EXAMPLES

Two metal alloys consistent with the present invention were prepared by making additions of Nb at a content of 0.01-6 at % relative to the two different alloys, Alloy 1 and Alloy 2. C and Ni were also included in some of the Nb modified alloys. The composition of these alloys is given in Table 1, below.

TABLE 1

Composition of Alloys

| Alloy Designation | Stoichiometry |
|---|---|
| Alloy 1 | $Fe_{52.3}Mn_2Cr_{19}Mo_{2.5}W_{1.7}B_{16}C_4Si_{2.5}$ |
| $Nb_2$ Modified Alloy 1 | $(Fe_{52.3}Mn_2Cr_{19}Mo_{2.5}W_{1.7}B_{16}C_4Si_{2.5})_{98} + Nb_2$ |
| $Nb_4$ Modified Alloy 1 | $(Fe_{52.3}Mn_2Cr_{19}Mo_{2.5}W_{1.7}B_{16}C_4Si_{2.5})_{96} + Nb_4$ |
| $Nb_2C_3$ Modified Alloy 1 | $(Fe_{52.3}Mn_2Cr_{19}Mo_{2.5}W_{1.7}B_{16}C_4Si_{2.5})_{95} + Nb_2 + C_3$ |
| $Nb_4C_3$ Modified Alloy 1 | $(Fe_{52.3}Mn_2Cr_{19}Mo_{2.5}W_{1.7}B_{16}C_4Si_{2.5})_{93} + Nb_4 + C_3$ |
| $Nb_2Ni_4$ Modified Alloy 1 | $(Fe_{52.3}Mn_2Cr_{19}Mo_{2.5}W_{1.7}B_{16}C_4Si_{2.5})_{94} + Nb_2 + Ni_4$ |
| Alloy 2 | $(Fe_{54.7}Mn_{2.1}Cr_{20.1}Mo_{2.5}W_{1.8}B_{16.3}C_{0.4}Si_{2.2})$ |
| $Nb_2$ Modified Alloy 2 | $(Fe_{54.7}Mn_{2.1}Cr_{20.1}Mo_{2.5}W_{1.8}B_{16.3}C_{0.4}Si_{2.2})_{98} + Nb_2$ |
| $Nb_4$ Modified Alloy 2 | $(Fe_{54.7}Mn_{2.1}Cr_{20.1}Mo_{2.5}W_{1.8}B_{16.3}C_{0.4}Si_{2.2})_{96} + Nb_4$ |
| $Nb_6$ Modified Alloy 2 | $(Fe_{54.7}Mn_{2.1}Cr_{20.1}Mo_{2.5}W_{1.8}B_{16.3}C_{0.4}Si_{2.2})_{94} + Nb_6$ |

The densities of the alloys are listed in Table 2 and were measured using the Archimedes method. A person of ordinary skill in the art would recognize that the Archimedes method utilizes the principal that the apparent weight of an object immersed in a liquid decreases by an amount equal to the weight of the volume of the liquid that it displaces.

TABLE 2

Alloy Densities

| Alloy Designation | Density (g/cm$^3$) |
|---|---|
| Alloy 1 | 7.59 |
| $Nb_2$ Modified Alloy 1 | 7.62 |
| $Nb_4$ Modified Alloy 1 | 7.65 |
| $Nb_2C_3$ Modified Alloy 1 | 7.58 |
| $Nb_4C_3$ Modified Alloy 1 | 7.63 |
| $Nb_2Ni_4$ Modified Alloy 1 | 7.69 |
| Alloy 2 | 7.63 |
| $Nb_2$ Modified Alloy 2 | 7.65 |
| $Nb_4$ Modified Alloy 2 | 7.68 |
| $Nb_6$ Modified Alloy 2 | 7.71 |

Each alloy described in Table 1 was melt-spun at wheel tangential velocities equivalent to 15 m/s and 5 m/s. For each sample of melt-spun ribbon material for each alloy, differential thermal analysis (DTA) and differential scanning calorimetry (DSC) was performed at heating rates of 10° C./minute. A person of ordinary skill in the art would recognize DTA involves measuring the temperature difference that develops between a sample and an inert reference material while both sample and reference are subjected to the same temperature profile. A person of ordinary skill in the art would recognize DSC as a method of measuring the difference in the amount of energy necessary to heat a sample and a reference at the same rate. In Table 3, the onset and peak temperatures are listed for each crystallization exotherm.

TABLE 3

| Alloy Designation | Wheel Speed (m/s) | Peak 1 Onset (° C.) | Peak 1 Peak (° C.) | Peak 2 Onset (° C.) | Peak 2 Peak (° C.) | Peak 3 Onset (° C.) | Peak 3 Peak (° C.) | Peak 4 Onset (° C.) | Peak 4 Peak (° C.) |
|---|---|---|---|---|---|---|---|---|---|
| | | Differential Thermal Analysis Crystallization | | | | | | | |
| Alloy 1 | 15 | 618 | 627 | | | | | | |
| Alloy 1 | 5 | — | — | | | | | | |
| $Nb_2$ Modified Alloy 1 | 15 | 621 | 631 | 660 | 677 | 718 | 735 | 769 | 784 |
| $Nb_2$ Modified Alloy 1 | 5 | 623 | 632 | 656 | 673 | 718 | 734 | 767 | 783 |
| $Nb_4$ Modified Alloy 1 | 15 | 630 | 641 | 697 | 708 | 733 | 741 | 847 | 862 |
| $Nb_4$ Modified Alloy 1 | 5 | 628 | 638 | 685 | 698 | 727 | 741 | 812 | 825 |
| $Nb_2C_3$ Modified Alloy 1 | 15 | 644 | 654 | 706 | 716 | 730 | 752 | | |
| $Nb_2C_3$ Modified Alloy 1 | 5 | 651 | 660 | 710 | 724 | 773 | 786 | | |
| $Nb_4C_3$ Modified Alloy 1 | 15 | 654 | 662 | 738 | 750 | 785 | 799 | | |
| $Nb_4C_3$ Modified Alloy 1 | 5 | 553 | 661 | 739 | 749 | 783 | 796 | | |
| $Nb_2Ni_4$ Modified Alloy 1 | 15 | 590 | 602 | 664 | 674 | 742 | 762 | | |
| $Nb_2Ni_4$ Modified Alloy 1 | 5 | 593 | 604 | 668 | 678 | 747 | 765 | | |
| Alloy 2 | 15 | 576 | 587 | 622 | 631 | | | | |
| Alloy 2 | 5 | — | — | | | | | | |
| $Nb_2$ Modified Alloy 2 | 15 | 596 | 608 | 691 | 699 | 813 | 827 | | |
| $Nb_2$ Modified Alloy 2 | 5 | 839 | 859 | | | | | | |
| $Nb_4$ Modified Alloy 2 | 15 | 615 | 630 | 725 | 733 | 785 | 799 | | |
| $Nb_4$ Modified Alloy 2 | 5 | 727 | 735 | 794 | 807 | | | | |
| $Nb_6$ Modified Alloy 2 | 15 | 623 | 649 | 743 | 754 | 782 | 790 | | |
| $Nb_6$ Modified Alloy 2 | 5 | 740 | 751 | 777 | 786 | | | | |

With respect to Alloy 1, as can be seen from Table 3, the addition of the Nb causes glass devitrification in three or four stages, evidenced by the multiple crystallization events. The stability of the first crystallization event increases as well, except for the Nb/Ni modified alloys. Furthermore, multiple glass crystallization peaks are observed in all cases where Nb has been added to Alloy 1.

With respect to Alloy 2, an increase in glass stability with multiple crystallization events is observed with the addition of Nb, except for the $Nb_2$ modified alloy at a quench rate of 5 m/s. At quench rates of 15 m/s, the alloys demonstrate three crystallization events. Furthermore, the crystallization temperature increases with the addition of Nb.

All alloy compositions were melt-spun at 15 m/s and 5 m/s and the crystallization enthalpy was measured using differential scanning calorimetry. In Table 4, the total crystallization enthalpy is shown for each alloy melt-spun at 15 m/s and 5 m/s. Assuming that the 15m/s samples are 100% glass, the percent glass found in the lower cooling rate corresponding to quenching at 5 m/s can be found by taking the ratio of crystallization enthalpies, shown in Table 4.

TABLE 4

| Alloy Designation | Enthalpy at 15 m/s (−J/g) | Enthalpy at 5 m/s (−J/g) | Glass at 5 m/s |
|---|---|---|---|
| | Total Crystallization Enthalpy Released and % Glass at 5 m/s | | |
| Alloy 1 | 104.5 | 0 | 0 |
| $Nb_2$ Modified Alloy 1 | 77.8 | 56.3 | 72.4 |
| $Nb_4$ Modified Alloy 1 | 84.1 | 83.5 | 99.3 |
| $Nb_2C_3$ Modified Alloy 1 | 108.8 | 91.4 | 84.0 |
| $Nb_4C_3$ Modified Alloy 1 | 113.2 | 72.8 | 64.3 |
| $Nb_2Ni_4$ Modified Alloy 1 | 95.5 | 74.7 | 78.2 |
| Alloy 2 | 89.1 | 0 | 0 |
| $Nb_2$ Modified Alloy 2 | 90.9 | 10.3 | 11.3 |

TABLE 4-continued

| Alloy Designation | Enthalpy at 15 m/s (−J/g) | Enthalpy at 5 m/s (−J/g) | Glass at 5 m/s |
|---|---|---|---|
| | Total Crystallization Enthalpy Released and % Glass at 5 m/s | | |
| $Nb_4$ Modified Alloy 2 | 100.9 | 83.2 | 82.5 |
| $Nb_6$ Modified Alloy 2 | 113.8 | 56.9 | 50.0 |

With respect to Alloy 1, the base alloy (Alloy 1) was found to not form a glass when processed at low cooling rates equivalent to melt-spinning at a tangential velocity of 5 m/s. However, it was found that the niobium addition greatly enhances glass forming ability in all of the modified alloys, with the exception of the $Nb_4C_3$ modified Alloy. In the best case, $Nb_4$ Modified Alloy 1, it was found that 99.3% glass formed when processed at 5 m/s.

Similarly, in Alloy 2, the alloy was found not to form a glass when processed at low cooling rates equivalent melt-spinning at a tangential velocity of 5 m/s. However, it was found that the glass forming ability was enhanced with the niobium addition. In the best case of $Nb_4$ Modified Alloy 2, the amount of glass at 5 m/s was found to be 82.5%.

The melting events for each alloy composition melt-spun at 15 m/s are shown in Table 5. The melting peaks represent the solidus curves since they were measured upon heating so the liquidus or final melting temperatures would be slightly higher. However, the melting peaks demonstrate how the melting temperature will vary as a function of alloy addition. The highest temperature melting peak for Alloy 1 is found to be 1164° C. The addition of niobium was found to raise the melting temperature but the change was slight, with the maximum observed at 43° C. for $Nb_4$ Modified Alloy 1. The upper melting peak for Alloy 2 was found to be 1232° C. Generally, the addition of niobium to this alloy did not cause a significant change in melting point since all of the alloys peak melting temperatures were within 6° C.

TABLE 5

| Alloy Designation | Wheel Speed (m/s) | Peak 1 Onset (° C.) | Peak 1 Peak (° C.) | Peak 2 Onset (° C.) | Peak 2 Peak (° C.) | Peak 3 Onset (° C.) | Peak 3 Peak (° C.) |
|---|---|---|---|---|---|---|---|
| | Differential Thermal Analysis Melting | | | | | | |
| Alloy 1 | 15 | 1127 | 1133 | 1157 | 1164 | | |
| $Nb_2$ Modified Alloy 1 | 15 | 1156 | 1162 | 1166 | 1167 | 1170 | 1174 |
| $Nb_4$ Modified Alloy 1 | 15 | 1160 | 1168 | 1194 | 1199 | 1205 | 1207 |
| $Nb_2C_3$ Modified Alloy 1 | 15 | 1122 | 1126 | 1130 | 1135 | 1172 | 1180 |
| $Nb_4C_3$ Modified Alloy 1 | 15 | 1140 | 1146 | 1150 | 1156 | 1169 | 1180 |
| $Nb_2Ni_4$ Modified Alloy 1 | 15 | 1152 | 1159 | 1163 | 1165 | 1171 | 1174 |
| Alloy 2 | 15 | 1171 | 1182 | 1218 | 1224 | 1229 | 1232 |
| $Nb_2$ Modified Alloy 2 | 15 | 1199 | 1211 | 1218 | 1219 | 1222 | 1226 |
| $Nb_4$ Modified Alloy 2 | 15 | 1205 | 1208 | 1223 | 1226 | | |
| $Nb_6$ Modified Alloy 2 | 15 | 1213 | 1224 | 1232 | 1234 | | |

The hardness of the Alloy 1 and 2 and the Nb modified alloys was measured on samples heat treated at 750° C. for 10 minutes and the results are given in Table 6. Hardness was measured using Vickers Hardness Testing at an applied load of 100 kg following the ASTM E384-99 standard test protocols. A person of ordinary skill in the art would recognize that in the Vickers Hardness Test, a small pyramidal diamond is pressed into the metal being tested. The Vickers Hardness number is the ratio of the load applied to the surface area of the indentation. As can be seen, all of the alloys exhibited a hardness at HV100 over 1500 kg/mm$^2$. As shown, the hardness of Alloy 1 was found to be 1650 kg/mm2 and in all of the niobium alloys the effect of the niobium was to increase hardness, except for $Nb_2Ni_4$ Modified Alloy 1. The highest hardness was found in $Nb_2C_3$ Modified Alloy 1 and was 1912 kg/mm$^2$. This reportedly may be the highest hardness ever found in any iron based glass nanocomposite material. The lower hardness found in $Nb_2Ni_4$ Modified Alloy 1 is believed to be offset by the nickel addition which lowered hardness.

For Alloy 2, a reduced change in hardness was observed as a result of the niobium addition. This may be due to the near perfect nanostructures which are easily obtainable by the high cooling rates in melt-spinning of Alloy 2. It is believed that for weld alloys that the niobium addition may result in high hardness because it may assist in obtaining a fine structure according to the increase in glass forming ability, glass stability, and the inhibition of grain growth by multiple crystallization paths. A case example is also shown in Case Example 3.

The yield strength of the devitrified structures can be calculated using the relationship: yield stress ($\sigma_y$)=⅓VH (Vickers Hardness). The resulting estimates were between 5.2 to 6.3 GPa.

TABLE 6

| Alloy Designation | Condition | HV100 (kg/mm$^2$) | HV100 (GPa) |
|---|---|---|---|
| Summary of Hardness Results on 15 m/s Ribbon | | | |
| Alloy 1 | 750° C. - 10 min | 1650 | 16.18 |
| $Nb_2$ Modified Alloy 1 | 750° C. - 10 min | 1779 | 17.45 |
| $Nb_4$ Modified Alloy 1 | 750° C. - 10 min | 1786 | 17.51 |
| $Nb_2C_3$ Modified Alloy 1 | 750° C. - 10 min | 1912 | 18.75 |
| $Nb_4C_3$ Modified Alloy 1 | 750° C. - 10 min | 1789 | 17.55 |

TABLE 6-continued

| Alloy Designation | Condition | HV100 (kg/mm$^2$) | HV100 (GPa) |
|---|---|---|---|
| Summary of Hardness Results on 15 m/s Ribbon | | | |
| $Nb_2Ni_4$ Modified Alloy 1 | 750° C. - 10 min | 1595 | 15.64 |
| Alloy 2 | 750° C. - 10 min | 1567 | 15.37 |
| $Nb_2$ Modified Alloy 2 | 750° C. - 10 min | 1574 | 15.44 |
| $Nb_4$ Modified Alloy 2 | 750° C. - 10 min | 1544 | 15.14 |
| $Nb_6$ Modified Alloy 2 | 750° C. - 10 min | 1540 | 15.10 |

Example 1

Industrial Gas Atomization Processing to Produce Feedstock Powder

To produce feed stock powder for plasma transfer arc welding (PTAW) trials, Alloy 1, $Nb_2Ni_4$ Modified Alloy 1 and $Nb_2$ Modified Alloy 1 were atomized using inter gas atomization system in argon. The as-atomized powder was sieved to yield a cut which was either +50 μm to −150 μm or +75 μm to −150 μm, depending on the flowability of the powder. Differential thermal analysis was performed on each gas atomized alloy and compared to the results of melt-spinning for the alloys, illustrated in FIGS. 1-3.

FIG. 1 illustrates DTA plots of Alloy 1 are displayed. Profile 1 represents Alloy 1 processed into ribbon by melt spinning at 15 m/s. Profile 2 represents Alloy 1 gas atomized into powder and then sieved below 53 um.

Figure 2:
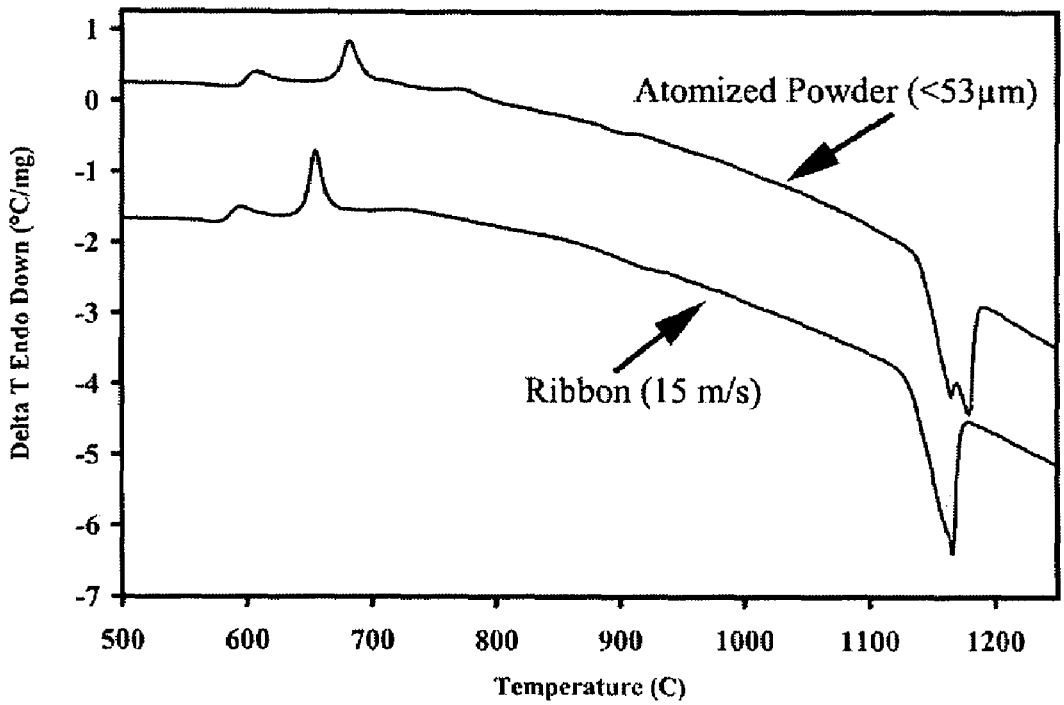
FIG. 2 illustrates DTA plots of $Nb_2Ni_4$ Modified Alloy 1 melt spun and gas atomized.

FIG. 2 illustrates DTA plots of $Nb_2Ni_4$ Modified Alloy 1. Profile 1 represents $Nb_2Ni_4$ Modified Alloy 1 processed into ribbon by melt spinning at 15 m/s. Profile 2 represents $Nb_2Ni_4$ Modified Alloy 1 gas atomized into powder and then sieved below 53 um.

Figure 3:
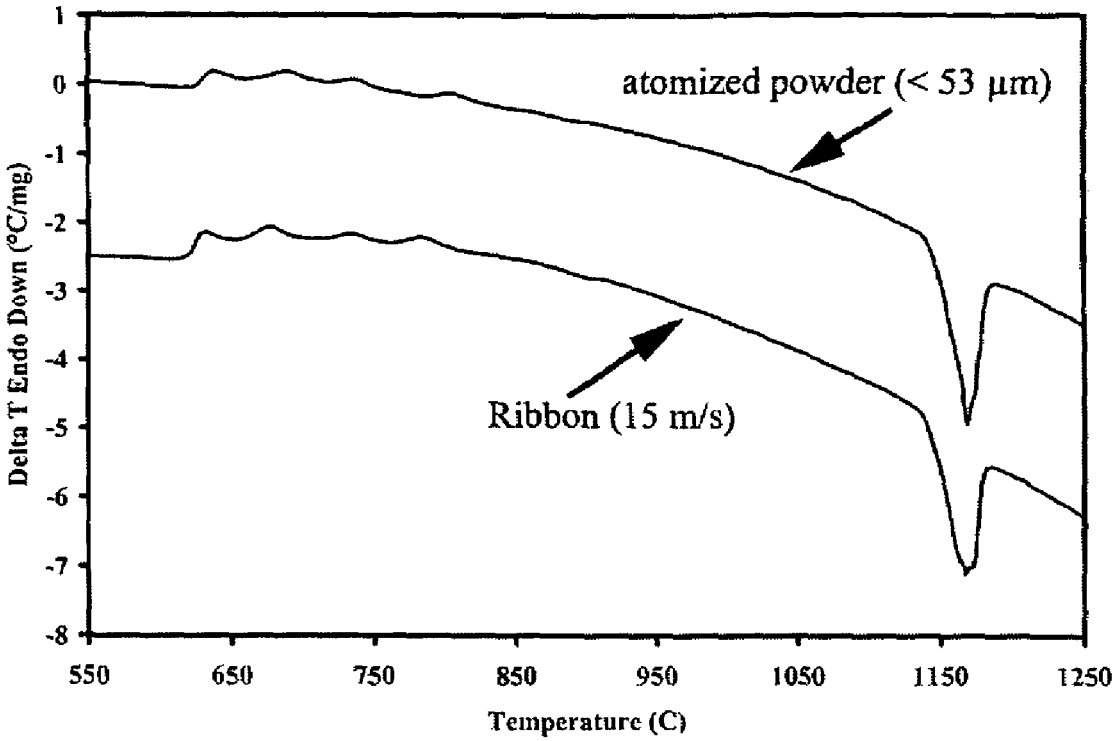
FIG. 3 illustrates DTA plots of $Nb_2$ Modified Alloy 1 melt spun and gas atomized.

FIG. 3 illustrates DTA plots of $Nb_2$ Modified Alloy 1. Profile 1 represents $Nb_2$ Modified Alloy 1 processed into ribbon by melt spinning at 15 m/s. Profile 2 represents $Nb_2$ Modified Alloy 1 gas atomized into powder and then sieved below 53 um.

Example 2

PTAW Weld Hardfacing Deposits

Plasma Transferred Arc Welding (PTAW) trials were done using a Stellite Coatings Starweld PTAW system with a Model 600 torch with an integrated side-beam travel carriage. Plasma transferred arc welding would be recognized by a person of ordinary skill in the art as heating a gas to an extremely high temperature and ionizing the gas so that it becomes electrically conductive. The plasma transfers the electrical arc to the workpiece, melting the metal.

Figure 4:
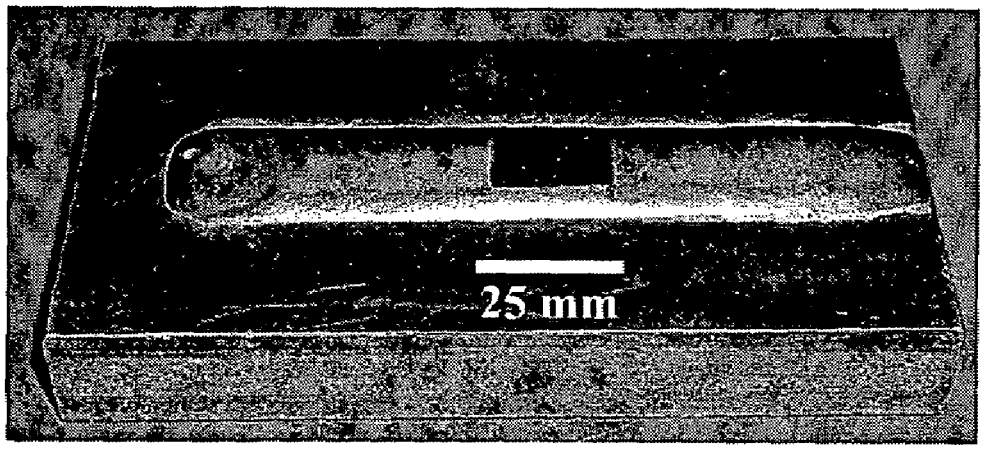
FIG. 4 illustrates a typical linear bead weld specimen for Alloy 1.

All welding was in the automatic mode using transverse oscillation and a turntable was used to produce the motion for the circular bead-on-plate tests. For all weld trials done the shielding gas that was used was argon. Transverse oscillation was used to produce a bead with a nominal width of ¾ inches and dwell was used at the edges to produce a more uniform contour. Single pass welds were made onto 6 inch by 3 inch by 1 inch bars with a 600° F. preheat as shown for the Alloy 1 PTA weld in FIG. 4.

Hardness measurements using Rockwell were made on the ground external surface of the linear crack specimens. Since Rockwell C measurements are representative of macrohardness measurements, one may take these measurements on the external surface of the weld. Additionally Vickers hardness measurements were taken on the cross section of the welds and tabulated in the Fracture Toughness Measurements Section. Since Vickers hardness measurements are microhardness one may make the measurements on the cross section of the welds which gives the additional benefit of being able to measure the hardness from the outside surface to the dilution layer in the weld. In Table 7, the welding parameters for each sample, bead height and Rockwell hardness results are shown for the linear bead hardness test PTAW specimens.

TABLE 7

Hardness Test Specimens

| Alloy Designation | Pre-heat (° F.) | Amps | Volts | Gas Flow | Powder FD Rate (g/min) | Travel Speed IPM | Bead Height (in) | Rc Avg |
|---|---|---|---|---|---|---|---|---|
| Alloy 1 | 600 | 200 | 30.5 | 120 | 29 | 2.0 | 0.130 | 65 |
| Alloy 1 | 600 | 200 | 30.5 | 120 | 29 | 2.0 | 0.130 | 66 |
| $Nb_2$ Modified Alloy 1 | 600 | 175 | 27.8 | 120 | 29 | 1.84 | 0.097 | 64 |
| $Nb_2$ Modified Alloy 1 | 600 | 175 | 27.8 | 120 | 29 | 1.84 | 0.093 | 64 |
| $Nb_2Ni_4$ Modified Alloy 1 | 600 | 174 | 27.8 | 120 | 29 | 1.8 | 0.127 | 57 |
| $Nb_2Ni_4$ Modified Alloy 1 | 600 | 174 | 27.8 | 120 | 29 | 1.8 | 0.131 | 56 |

Figure 5:
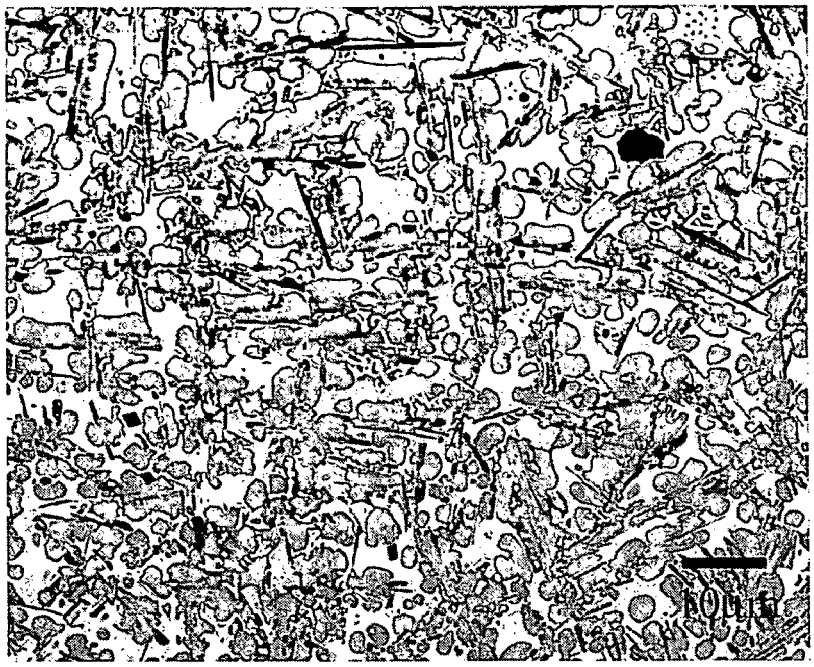
FIG. 5 illustrates a backscattered electron micrograph of the cross section of the Alloy 1 weld which was deposited with a 600° F. preheat prior to welding.
Figure 6:
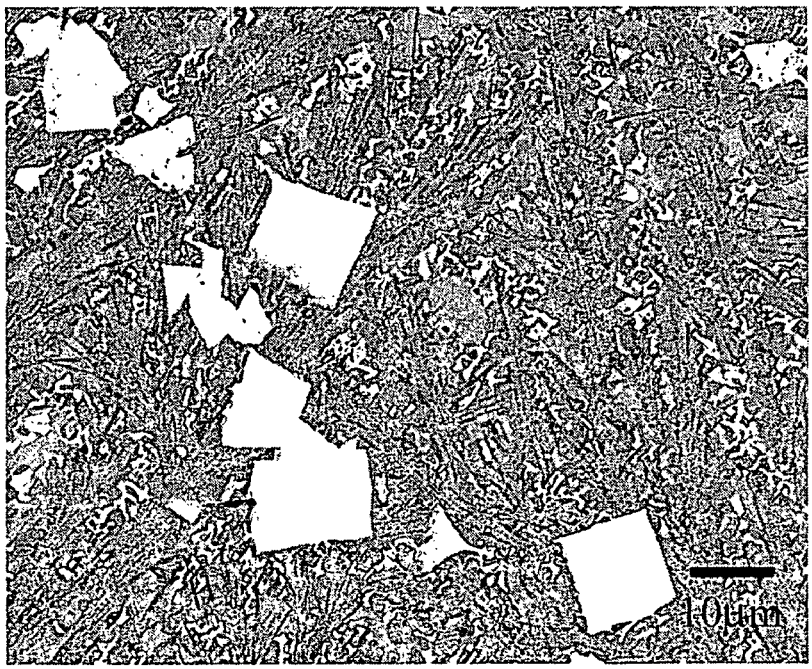
FIG. 6 illustrates a backscattered electron micrograph of the cross section of the $Nb_2Ni_4$ Modified Alloy 1 weld which was deposited with a 600° F. preheat prior to welding.
Figure 7:
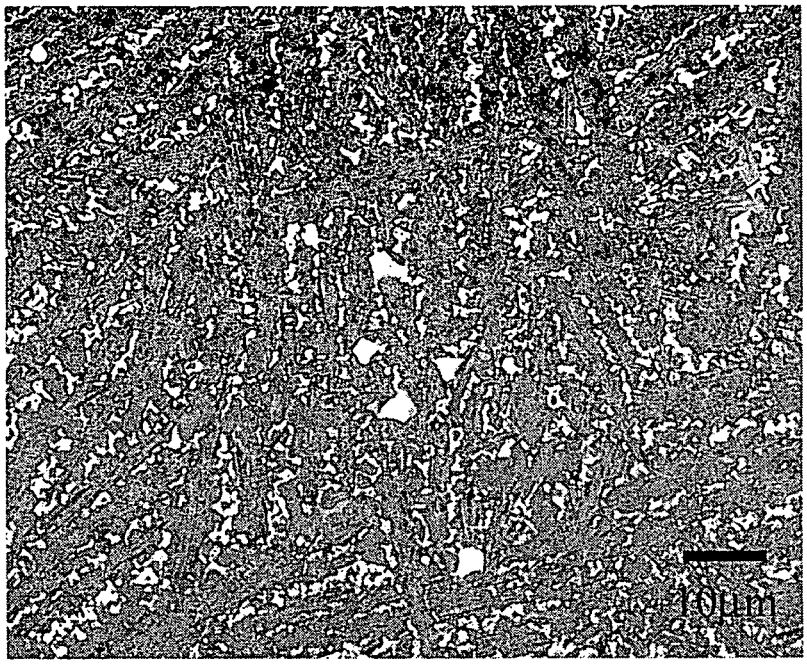
FIG. 7 illustrates a backscattered electron micrograph of the cross section of the $Nb_2$ Modified Alloy 1 weld which was deposited with a 600° F. preheat prior to welding.

Backscattered electron micro graphs were taken of the cross section of Alloy 1, $Nb_2Ni_4$ Modified Alloy 1 and $Nb_2$ Modified Alloy 1, illustrated in FIGS. 5-7 respectively. One matrix phase, considered to be α-Fe was observed in Alloy 1 and two matrix phases, considered to be α-Fe+ borocarbides phase were found in the $Nb_2Ni_4$ Modified Alloy 1 and the $Nb_2$ Modified Alloy 1. Note that the two phase structure observed in these later alloys are considered to be representative of a Lath Eutectoid which is somewhat analogous to the formation of lower bainite in conventional steel alloys. The remaining phases appear to be carbides and boride phases which form either at high temperature in the liquid melt or form discrete precipitates from secondary precipitation during solidification. Examination of the microstructures reveals that the microstructural scale of Alloy 1 is in the range of 3 to 5 microns. In both of the Nb Modified Alloys, the microstructural scale is refined significantly to below one micron in size. Note also that cubic phases were found in the $Nb_2Ni_4$ Modified Nine, one hour X-ray diffraction scans of the PTAW samples were performed. The scans were performed using filtered Cu Kα radiation and incorporating silicon as a standard. The diffraction patterns were then analyzed in detail using Rietvedlt refinement of the experimental patterns. The identified phases, structures and lattice parameters Alloy 1, $Nb_2Ni_4$ Modified Alloy 1 and $Nb_2$ Modified Alloy 1 are shown in Tables 8, 9, and 10 respectively.

TABLE 8

Phases Identified in the Alloy 1 PTAW

| Phase | Crystal System | Space Group | Lattice Parameter(s) (Å) |
|---|---|---|---|
| α-Fe | Cubic | Im3m | 2.894 |
| $M_{23}(BC)_6$ | Cubic | Fm3m | 10.690 |
| $M_7(CB)_3$ | Orthorhombic | Pmcm | a = 7.010, b = 12.142, c = 4.556 |

TABLE 9

Phases Identified in the $Nb_2Ni_4$ Alloy 1 PTAW

| Phase | Crystal System | Space Group | Lattice Parameter(s) (Å) |
|---|---|---|---|
| α-Fe | Cubic | Im3m | 2.886 |
| γ-Fe | Cubic | Fm-3m | 3.607 |
| $M_{23}(BC)_6$ | Cubic | Fm3m | 10.788 |

TABLE 9-continued

| Phases Identified in the $Nb_2Ni_4$ Alloy 1 PTAW | | | |
|---|---|---|---|
| Phase | Crystal System | Space Group | Lattice Parameter(s) (Å) |
| $M_7(CB)_3$ | Orthorhombic | Pmcm | a = 6.994, b = 12.232, c = 4.432 |

TABLE 10

| Phases Identified in the $Nb_2$ Alloy 1 PTAW | | | |
|---|---|---|---|
| Phase | Crystal System | Space Group | Lattice Parameter(s) (Å) |
| α-Fe | Cubic | Im3m | 2.877 |
| γ-Fe | Cubic | Fm-3m | 3.602 |
| $M_{23}(BC)_6$ | Cubic | Fm3m | 10.818 |
| $M_7(CB)_3$ | Orthorhombic | Pmcm | a = 7.014, b = 12.182, c = 4.463 |

Noted from the results of the x-ray diffraction data, is that niobium addition caused face centered cubic iron (i.e. austenite) to form along with the α-Fe which was found in Alloy 1. For all the samples, the main carbide phase present is a $M_7C_3$ while the main boride phase in all of the PTAW samples has been identified as a $M_{23}B_6$. Furthermore, limited EDS (Energy Dispersive X-Ray Spectroscopy) analysis demonstrated the carbide phase contains a considerable amount of boron and that the boride phase contains a considerable amount of carbon. Thus, all of these phases can also be considered as borocarbides. Also, note that while similar phases are found in a number of these PTAW weld alloys, the lattice parameters of the phases change as a function of alloy and weld conditions, Table 7, indicating the redistribution of alloying elements dissolved in the phases. The iron based PTAW microstructures can be generally characterized as a continuous matrix comprised of ductile α-Fe and/or γ-Fe dendrites or eutectoid laths intermixed with hard ceramic boride and carbide phases.

The fracture toughness was measured using the Palmqvist method. A person of ordinary skill in the art would recognize that the Palmqvist method involves the application of a known load to a Vickers diamond pyramid indenter that results in an impacted indentation into the surface of the specimen. The applied load must be greater than a critical threshold load in order to cause cracks in the surface at or near the corners of the indentation. It is understood that cracks are nucleated and propagated by unloading the residual stresses generated by the indentation process. The method is applicable at a range at which a linear relationship between the total crack length and the load is characterized.

The fracture toughness may be calculated using Shetty's equation, as seen in Equation 1.

Shetty's Equation — Equation 1

$$K_{IC} = \left(\frac{1}{3(1-\nu^2)\sqrt{\pi}\sqrt[3]{\sqrt{2}\,\pi\tan\psi}}\right)\sqrt{H}\sqrt{\frac{P}{4a}}$$

Wherein ν is Poisson's ratio, taken to 0.29 for Fe, ψ is the half-angle of the indenter, in this case 68°, H is the hardness, P is the load and 4*a* is the total linear crack length. The average of five measurements of microharness data along the thickness of the weld was used to determine the fracture toughness reported. The crack resistance parameter, W, is the inverse slope of the linear relation between crack length and load and is represented by P/4*a*.

Two crack length measuring conventions were chosen for evaluation. The first convention is designated as Crack Length (CL) and is the segmented length of the actual crack including curves and wiggles beginning from the indentation edge to the crack tip. The second convention is called the Linear Length (LL) and is the length of the crack from its root at the indentation boundary to the crack tip. Initial indentations were made with nominal 50 kg and 100 kg loads and based on the appearance of these indentations, a range of loads was selected.

The crack lengths for the two conventions were measured by importing the digital micrographs into a graphics program that used the bar scale of the image to calibrate the distances between pixels so that the crack lengths could accurately be measured. A spread sheet design was used to reduce the data for computing the fracture toughness. This data was plotted and a linear least squares fit was computed in order to determine the slope and the corresponding $R^2$ value for each crack length convention and is shown in Table 11. This data, along with the hardness data, was inputted into Shetty's equation and the fracture toughness was computed and the results are shown in Table 12. It can be seen that Alloy 1 when PTA welded resulted in toughness values that were moderate. With the addition of niobium in the modified alloys, vast improvements in toughness were found in the $Nb_2Ni_4$ Modified Alloy 1 and the $Nb_2$ Modified Alloy 1.

TABLE 11

| Slope Data | | | | |
|---|---|---|---|---|
| Sample | CL Slope | LL Slope | CL $R^2$ | LL $R^2$ |
| Alloy 1 PTAW | 0.2769 | 0.2807 | 0.95 | 0.96 |
| $Nb_2Ni_4$ Modified Alloy 1 | 0.0261 | 0.0244 | 0.98 | 0.92 |
| $Nb_2$ Modified Alloy 1 | 0.0152 | 0.0136 | 0.85 | 0.85 |

TABLE 12

| Palmqvist Fracture Toughness (MPa $m^{1/2}$) | | |
|---|---|---|
| Sample | CL $K_{IC}$ | LL $K_{IC}$ |
| Alloy 1 PTAW | 17.4 | 17.3 |
| $Nb_2Ni_4$ Modified Alloy 1 | 48.2 | 49.9 |
| $Nb_2$ Modified Alloy 1 | 73.3 | 77.5 |

While not limiting the scope of this application, it is believed that the improvements in toughness found in the niobium alloys may be related to microstructural improvements which are consistent with the Crack Bridging model to describe toughness in hardfacing alloys. In Crack Bridging, the brittle matrix may be toughened through the incorporation of ductile phases which stretch, neck, and plastically deform in the presence of a propagating crack tip. Crack bridging toughening ($\Delta K_{cb}$) has been quantified in hardfacing materials according to the following relation; $\Delta K_{cb}=E_d[\chi V_f(\sigma_0/E_d)a_0]^{1/2}$ where $E_d$ is the modulus of the ductile phase, χ is the work of rupture for the ductile phase, $\sigma_0$ is the yield strength of the ductile phase, $a_0$ is the radius of the ductile phase, and $V_f$ is the volume fraction of ductile phase.

The reduction in microstructural scale as shown by the Hall-Petch relationship ($\sigma_y \approx kd^{1/2}$) and the increase in microhardness found from the niobium addition, is consistent with increasing yield strength. Increasing yield strength, increases the work of rupture resulting in the observed toughness increase. Increasing amounts of transition metals like niobium dissolved in the dendrite/cells would increase the modulus, thus increasing the toughness according to the Crack Bridging Model. Finally, the uniform distribution of fine (0.5 to 1 micron) $M_{23}(BC)_6$ and $M_7(BC)_3$ ceramic precipitates surrounded by a uniform distribution of ductile micron sized γ-Fe and α-Fe dendrites or eutectoid laths of is also expected to be especially potent for Crack Bridging.

Figure 8:
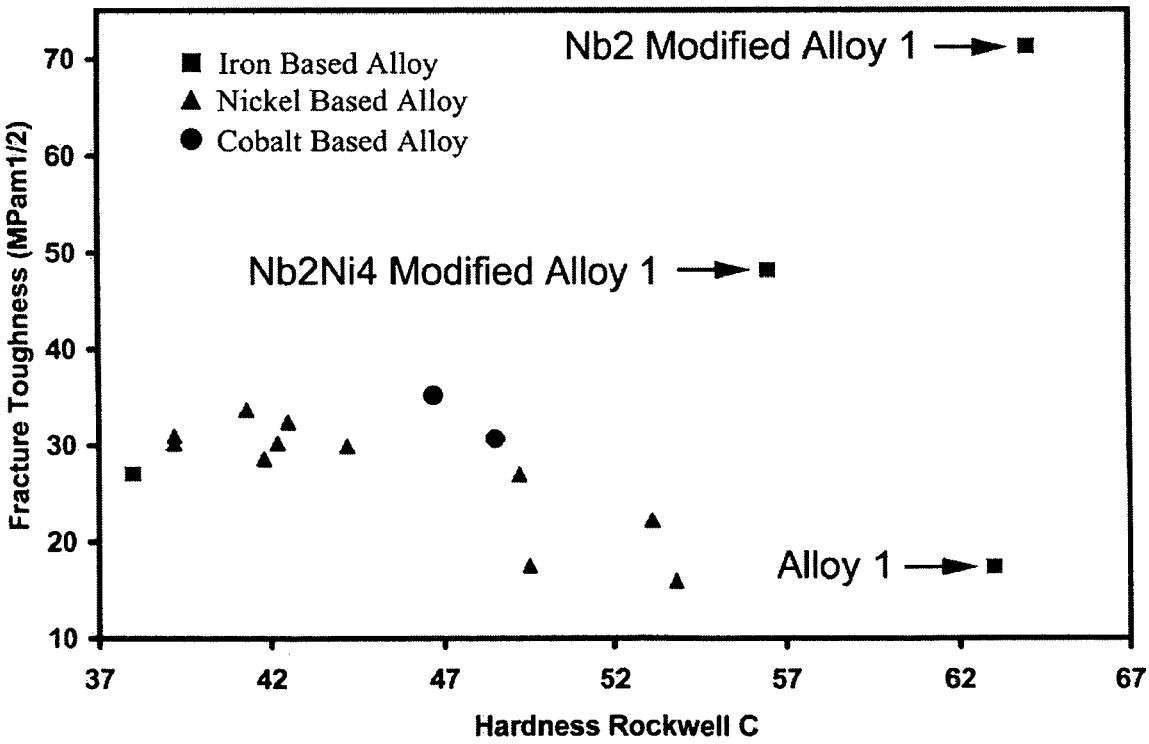
FIG. 8 illustrates the fracture toughness versus hardness for a number of iron based, nickel based and cobalt based PTAW hardfacing materials compared to Alloy 1, $Nb_2Ni_4$ Modified Alloy 1 and $Nb_2$ Modified Alloy 1.

FIG. 8 demonstrates the fracture toughness versus hardness for a number of iron based, nickel based and cobalt based PTAW hardfacing materials compared to Alloy 1, $Nb_2Ni_4$ Modified Alloy 1 and $Nb_2$ Modified Alloy 1. However, it should be noted that the iron, nickel and cobalt based studies were performed on pre-cracked compact tensile specimens and were measured on 5-pass welds. The measurements performed on Alloy 1, $Nb_2Ni_4$ Modified Alloy 1 and $Nb_2$ Modified Alloy 1 were measured on 1-pass welds.

Example 3

Hardness Improvement in Arc-Welded Ingots

A study was launched to verify the improvement in hardness in weld/ingot samples by adding niobium to Alloy 2. The alloy identified as $Nb_6$ modified Alloy 2 in Table 1 was made into a 12 lb charge using commercial purity feedstock. This alloy was then atomized into powder by a close coupled inert gas atomization system using argon as the atomization gas. The resulting powder was then screened to yield a PTA weldable product which was nominally +53 to −150 μm in size. To mimic the PTA process, a 15 gram ingot of powder was arc-welded into an ingot. The hardness of the ingot was then measured using Vickers at the 300 gram load. As shown, in Table 13, the hardness of the arc-welded sample ingot was very high at 1179 kg/mm$^2$ (11.56 GPa). Note that this hardness level corresponds to a hardness greater than the Rockwell C scale (i.e. Rc>68). Also, note that this hardness is greater than that achieved in Table 7 and that shown in FIG. 8. Thus, these results show that for arc-welding, where the cooling rate is much lower than melt-spinning that the niobium addition does indeed result in large improvements in hardness.

TABLE 13

Summary of Arc-Welded Hardness Data

| Arc-Welded Hardness | (kg/mm$^2$) | GPa |
|---|---|---|
| HV300 Indentation #1 | 1185 | 11.62 |
| HV300 Indentation #2 | 1179 | 11.56 |
| HV300 Indentation #3 | 1080 | 10.59 |
| HV300 Indentation #4 | 1027 | 10.07 |
| HV300 Indentation #5 | 1458 | 14.30 |

TABLE 13-continued

Summary of Arc-Welded Hardness Data

| Arc-Welded Hardness | (kg/mm$^2$) | GPa |
|---|---|---|
| HV300 Indentation #6 | 961 | 9.42 |
| HV300 Indentation #7 | 1295 | 12.70 |
| HV300 Indentation #8 | 1183 | 11.60 |
| HV300 Indentation #9 | 1225 | 12.01 |
| HV300 Indentation #10 | 1194 | 11.71 |
| HV300 Average | 1179 | 11.56 |

What is claimed is:

1. A method for increasing the hardness of an iron alloy composition comprising:

a) supplying an iron based glass alloy comprising about 40-65 atomic % iron and about 5.0-55 atomic percent of at least one metal selected from the group consisting of Ti, Zr, Hf, V, Ta, Cr, Mo, W, Mn, Ni or mixtures thereof;

b) adding 0.01 to 6 atomic % Niobium to said iron based glass alloy; and c) increasing said hardness by adding said Niobium to said iron based glass alloy, wherein said Niobium modified alloy is cooled at a rate sufficient to indicate a backscattered electron micrograph containing only microstructural scale structure with phases defined by x-ray diffraction as 1. α-Fe and/or γ-Fe, and
2. boro carbide phases comprising $M_{23}(BC)_6$ and/or $M_7(CB)_3$.

2. The method of claim 1 wherein said hardness is increased by at least 1 GPa.

3. A method for increasing the glass stabilization of an iron based alloy composition comprising:

a) supplying an iron based glass alloy comprising about 40-65 atomic % iron and about 5.0-55 atomic percent of at least one metal selected from the group consisting of Ti, Zr, Hf, V, Ta, Cr, Mo, W, Mn, Ni or mixtures thereof;

b) adding 0.01 to 6 atomic % Niobium to said iron based glass alloy; and c) increasing said crystallization temperature above 675° C. by adding said Niobium to said iron based glass alloy, wherein said Niobium modified alloy is cooled at a rate sufficient to indicate a backscattered electron micrograph containing only microstructural scale structure with phases defined by x-ray diffraction as 1. α-Fe and/or γ-Fe, and
2. boro carbide phases comprising $M_{23}(BC)_6$ and/or $M_7(CB)_3$.

* * * * *